US006883781B2

(12) United States Patent
Irving

(10) Patent No.: US 6,883,781 B2
(45) Date of Patent: Apr. 26, 2005

(54) TOOL FOR EXTRACTING THE REMNANTS OF SIGN POSTS AND METHOD FOR USING THE SAME

(76) Inventor: Robert Irving, 9532 Natasha Pl, Sidney B.C. (CA), V8L 4P9

( * ) Notice: Subject to any disclaimer, the term of this patent is extended or adjusted under 35 U.S.C. 154(b) by 105 days.

(21) Appl. No.: 10/318,030

(22) Filed: Dec. 13, 2002

(65) Prior Publication Data

US 2004/0113132 A1 Jun. 17, 2004

(51) Int. Cl.[7] ..... E21B 19/00

(52) U.S. Cl. ..... 254/30; 254/131; 29/255; 29/254

(58) Field of Search ..... 254/29–31, 132, 254/18, 25, 131; 29/255, 275, 270, 254

(56) References Cited

U.S. PATENT DOCUMENTS 344,653 A * 6/1886 Harmon ..... 7/166
4,482,131 A * 11/1984 Hamilton ..... 254/18
5,504,982 A * 4/1996 Sharp ..... 29/255
6,398,188 B1 * 6/2002 Salman ..... 254/30

* cited by examiner

*Primary Examiner*—Lee D. Wilson
(74) *Attorney, Agent, or Firm*—J. Gordon Thomson

(57) ABSTRACT

The tool is adapted for extracting the sheared remnant of a sign post having holes and comprises a shaft having a top and bottom end. To secure the tool to the remnant a clamp is provided comprising a stationary member integral to the bottom end of the shaft and a moveable member pivotally connected to the stationary member. Fixed to the stationary member is a guide member having a plurality of outwardly projecting pins. The pins have a diameter and spaced relationship adapted to correspond to the diameter and spaced relationship of the holes in the sign post remnant. When the clamp is inserted into the sign post remnant the pins will enter and tightly engage the holes in the signpost remnant. Connected to the top end of the shaft is a sliding hammer for imparting extraction forces to the sheared sign post remnant.

16 Claims, 12 Drawing Sheets

TOOL FOR EXTRACTING THE REMNANTS OF SIGN POSTS AND METHOD FOR USING THE SAME

CROSS REFERENCE TO RELATED APPLICATIONS

Please see U.S. Provisional Patent Application 60/339,333 filed on Dec. 12, 2001.

BACKGROUND

1. Field of the Invention

This invention relates to implements or apparatus for applying a pushing or pulling force having special engaging elements and an impact delivery component. More specifically, this invention relates to a tool for extracting the remnants of square sheared signposts and a method for using the same.

2. Background of the Invention

Proper signage and illumination is critical to road safety. Small roadway signs and luminaries are often mounted to square steel or aluminum posts. For safety reasons and to protect the occupants of out-of-control vehicles that may strike these posts, they are equipped with splices or breakaways that fail upon impact with the vehicle. The steel often used in the manufacture of sign posts is typically re-rolled rail steel or new billet steel conforming to the mechanical standards of ASTM A 499, Grade 420 and to the chemical requirements of ASTM A 1. One example is 80 ksi Marion™ steel having a weight of between three and four pounds per foot. The sign posts are typically punched along their centre lines. The punch holes are about 11 mm in diameter and are spaced at either 25 mm or 75 mm centers. The posts are generally galvanized according to ASTM A 123. The signposts are generally mounted in cement or concrete having specified standards such as Class "A" Portland™ cement. There are many other state and national standards and regulations, such as those promulgated by the Federal Highway Administration, the ATTSA, MUTCD and the AASHTO, that apply to such posts and breakaway standards but all generally demand high standards of safety and durability.

Once a steel post has been struck by a vehicle, the breakaway device permits the shear failure of the bottom portion of the post while retaining the post foundation in the ground. Within the post foundation, a remnant of the post often remains stuck and mutilated. Since the post has been struck with great force, the remnant is often very difficult to remove. In many cases, the remnant cannot be removed using available tools and therefore the entire post foundation may have to be excavated in order to install a new post. This creates additional expense for municipalities in terms of material and manpower required to excavate and reinstall a new sign post. Therefore, while breakaway devices are mandatory for public safety they can create costly maintenance disadvantages.

Known post-pulling devices such as the "T" Post Puller-Pounder described in U.S. Pat. No. 5,042,591 issued to Hull on Aug. 27, 1991 do not solve the problem of pulling remnants from sheared sign posts. The Hull device is too heavy to be easily used by a single person and is not adaptable to the problem described above.

Therefore, what is needed is a simple hand-operated device that can be used to extract the remnants of square sign posts from their anchors permitting the re-use of foundations and the easy re-installation of new sign posts. Such a device would significantly reduce the labour and cost required to perform this task and therefore is clearly desirable.

OBJECTS OF THE INVENTION

It is a general object of the present invention to overcome the stated deficiencies described above.

It is a further object of the present invention to provide an improved, simple, inexpensive and hand operated tool for extracting the remnants of square sign posts firmly embedded in their anchors.

SUMMARY OF THE INVENTION

In a preferred embodiment of the invention there is provided a tool for extracting the sheared remnants of square sign posts having holes comprising:

a. a shaft portion having a top and bottom end;

b. a sliding hammer mechanism connected to the top end of the shaft portion; and, c. clamping means positioned at the bottom end of the shaft portion for securely engaging the square sign post remnant. The motion of the sliding hammer mechanism imparts extraction forces through the shaft portion to the clamping means for extracting the signpost remnant.

The clamping means comprise:

a. a stationary clamp member fixed to the bottom end of the shaft portion;

b. a moveable clamp member pivotally connected to the stationary clamp member for pivoting movement towards and away from the stationary clamp member so that when the clamping means is inserted into the sign post remnant the stationary and moveable clamp members cooperate to permit firm engagement with the remnant for extraction; and, c. means for pivotally connecting the moveable clamp member to the stationary clamp member.

The stationary clamp member has a guide member mounted to it with a plurality of pins projecting outwardly from it. The pins have a diameter and spaced relationship adapted to correspond with the diameter and spaced relationship of the holes in the signpost remnant so that when the clamping means is inserted into the sign post remnant the pins on the guide member will enter and tightly engage the holes in the signpost remnant for extraction. In one embodiment of the invention there are three pins but the invention contemplates having more or fewer pins.

The moveable clamp member comprises a lower biasing portion and an upper handle portion. The moveable clamp member is pivotally connected to the stationary clamp member at a pivot point substantially located where the lower biasing portion and the upper handle portion join. The lower biasing portion is positioned opposite the stationary clamping member and the upper handle portion is positioned adjacent to the shaft portion.

In another embodiment of the invention the moveable clamp member has a stiffening member fixed to the top portion of the moveable clamp member at the pivot point. The stiffening member absorbs strain generated around the pivot point and the pivot connection caused by movement of the moveable clamping member. The stiffening member also provides additional biasing forces to the spring portion of the lower biasing portion of the moveable clamp member.

The lower biasing portion of the moveable clamping member includes a spring portion and bearing portion adjacent and integral to each other. The spring portion comprises a portion of the lower biasing portion angled upwards from the plane of the upper handle. The angle is sufficient to create a spring effect, generally, being about thirty degrees above the plane of the handle. The bearing portion is located at the end of the biasing portion and is curved downward to create a curved bearing portion for engagement with the inside of the signpost remnant. The curved portion also permits easy insertion of the clamping means into the remnant by deflecting away from any jagged edges of the remnant.

The clamping means has a first relaxed position and a second biased position. In the first relaxed position the moveable clamping member is pivoted towards the stationary clamping member by moving the handle portion in a direction away from the shaft so that the clamping means may be inserted into the signpost remnant. In the second biased position the handle portion is moved towards the shaft by hand forces causing the bearing section of the lower biasing portion to abut the inner surface of the signpost remnant and apply a biasing force to the spring section. This forces the guide member pins of the stationary clamping member into tight engagement with the holes of the signpost remnant for extraction.

There is also provided, in another embodiment of the invention, retaining means to retain the moveable clamp member handle portion is in a fixed position against the shaft portion when the tool is not in use. This prevents the moveable handle portion from movement and potentially damage to the handle and pivot connection when stored. The retaining means comprises a collar member moveably disposed on the shaft and handle and freely slidable on the shaft and handle between a first loose position and a second retaining position. The retaining position occurs when the handle portion lies flat against the shaft and the collar is moved up the shaft and handle until it frictionally and tightly engages, by hand forces, the handle portion and shaft to retain the handle portion stationary with respect to the shaft. To release the handle portion for pivoting movement, the retaining collar is slid down the handle portion and shaft to the pivot point.

The sliding hammer mechanism of the invention comprises an elongated rod having first and second ends and a first abutment stationarily mounted on the first end. The first end of the rod is connected to the top end of the shaft. A second abutment is stationarily mounted on the second end of the rod. An impact member is slideably mounted over the rod and is movably disposed on the rod. The impact member is freely slidable between the first and second abutments and applies a striking force to the first and second abutments. The impact member includes a safety collar to prevent the operator's hand from slipping from the impact member on the upwards stroke of the impact member.

Generally, all the components of the tool are machined from steel having a suitable hardness to withstand the impact forces generated by the tool during extraction of a sign post remnant.

In another embodiment of the invention there is provided a method for extracting the remnants of sheared square sign posts the method comprising the following steps:

a. providing a tool having:
   i. a shaft portion having a top and bottom end;
   ii. a sliding hammer mechanism connected to the top end of the shaft portion; and,
   iii. clamping means positioned at the bottom end of the shaft portion for securely engaging the square sign post remnant;
b. securely engaging clamping means to the sign post remnant; and,
c. causing the sliding hammer mechanism to impart extraction forces through the shaft portion to the clamp means for extracting the signpost remnant.

In another embodiment of the invention there is provided a method for extracting remnants of sheared square sign posts comprising the following steps:

a. providing a tool having:
   i. a shaft portion having a top and bottom end;
   ii. a sliding hammer mechanism connected to the top end of the shaft portion; and,
   iii. clamping means positioned at the bottom end of the shaft portion for securely engaging the square sign post remnant;
b. placing clamping means in a first relaxed position by pivoting the moveable clamping member toward the stationary clamping member by moving the handle portion in a direction away from the shaft;
c. inserting the relaxed clamping means into the signpost remnant so that all of the pins on the guide member will enter and tightly engage the holes in the signpost remnant;
d. biasing the moveable clamping member against the inside of the sign post remnant by moving the handle portion by hand forces towards the shaft thereby causing the bearing section to contact the inside surface of the signpost remnant and flexing the spring portion thereby forcing the guide member and pins of the stationary clamping member into tight engagement with the signpost remnant for extraction;
e. causing the sliding hammer mechanism to impart extraction forces through the shaft portion to the clamp means for extracting the signpost remnant Still further advantages and objects of the present invention will become apparent from a consideration of the ensuring description and drawings.

BRIEF DESCRIPTION OF THE DRAWINGS

The invention will be more readily understood by reference to the following description, taken with the accompanying drawings, in which.

DETAILED DESCRIPTION OF THE INVENTION

Figure 1:
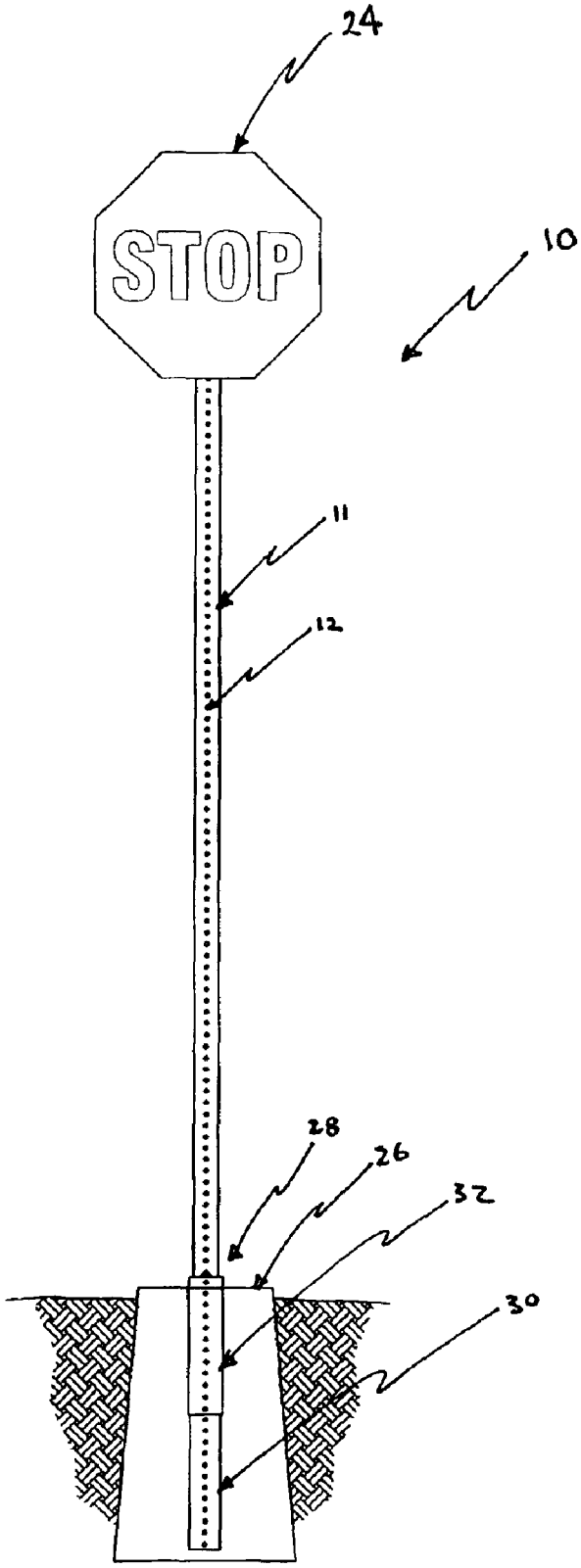
FIG. 1 illustrates a typical road sign installation.

Referring to FIG. 1, there is shown a typical street sign installation shown generally as (10). Square tube (11) posts made from aluminum or steel for small sign supports are popular in rural and urban applications. Typically the posts are furnished with mounting holes (12) on all four sides pre-punched at suitable spacings. Common post sizes ranges from 1.5 inches to 2.5 inches in either 12 or 14 gauge thickness. Typically the post is installed in a larger sized anchor post (30) which is in turn anchored in concrete (26). The sign (24) is mounted to the top of the post (11) using suitable mounting hardware. The bottom of the post is inserted into a prepared concrete foundation (26) including an anchor sleeve (32) having a breakaway feature shown generally as (28). The breakaway feature includes the anchor post (30) into which the sign post (11) is inserted and the anchor sleeve (32). Persons skilled in the art will understand that upon impacting the sign post with (11) an out-of-control vehicle the combination of the foundation (26), anchor post (30) and anchor sleeve (32) will cause the bottom of the post to shear off.

Figure 2:
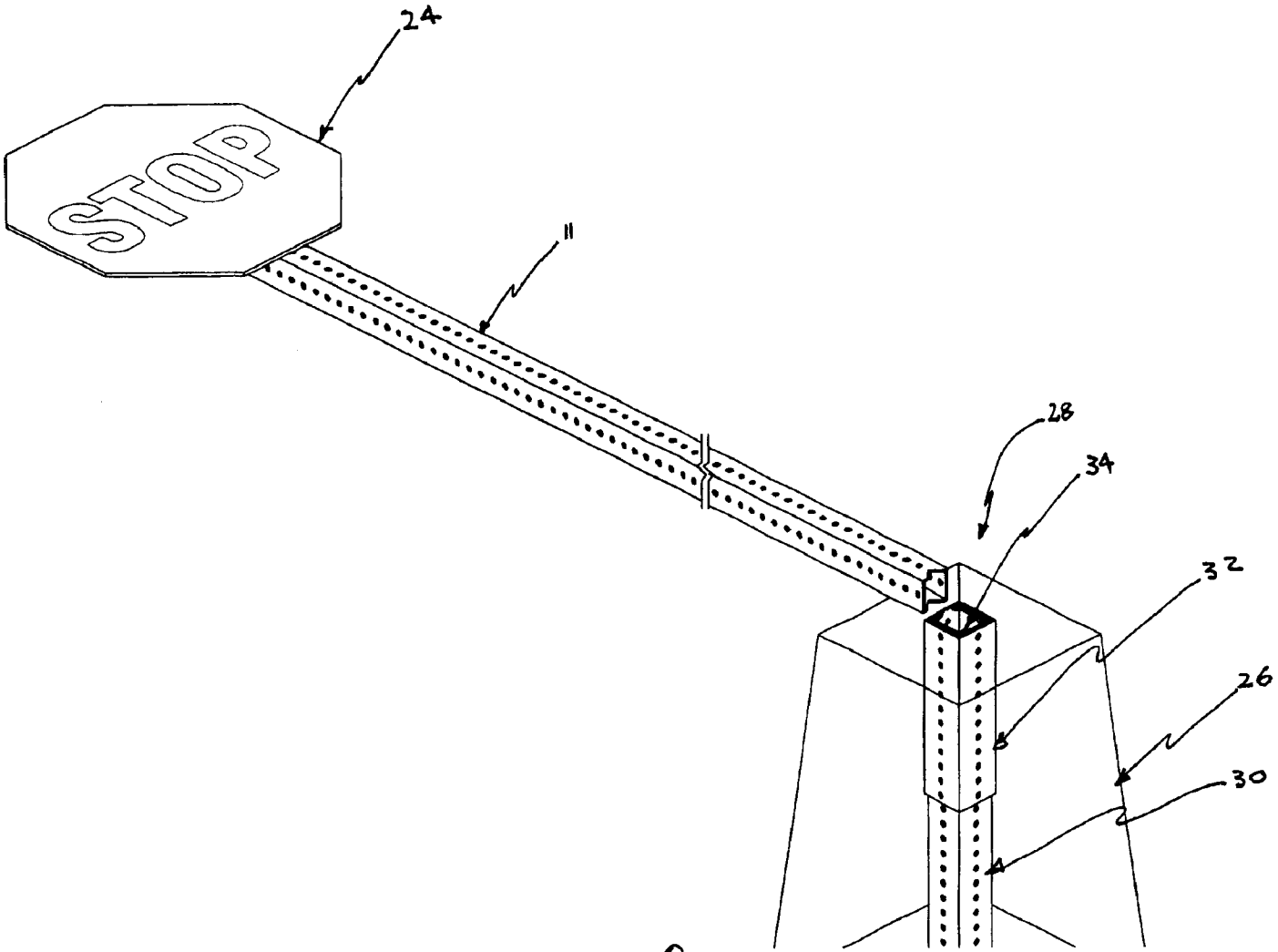
FIG. 2 illustrates a road sign after being struck by a vehicle and in particular illustrates the operation of the breakaway and the location of the sheared remnant within the sign post anchor.

Referring to FIG. 2, there is shown the typical result of a vehicle striking a sign post (11) with a breakaway feature (28). The post (11) is sheared off at the top of the anchor sleeve (32). The vehicle and its occupants are spared significant damage and the sign (24) and sign post (11) may be recycled thereby saving the municipality money. Also shown in this Figure is the post remnant (34) that remains within the anchor sleeve (32), the concrete foundation (26) and the anchor post (30) generally remain undamaged. The remnant (34) of the sign post is often badly twisted from the vehicle impact making its extraction very difficult using convention tools such as pry bars or pliers.

Figure 3:
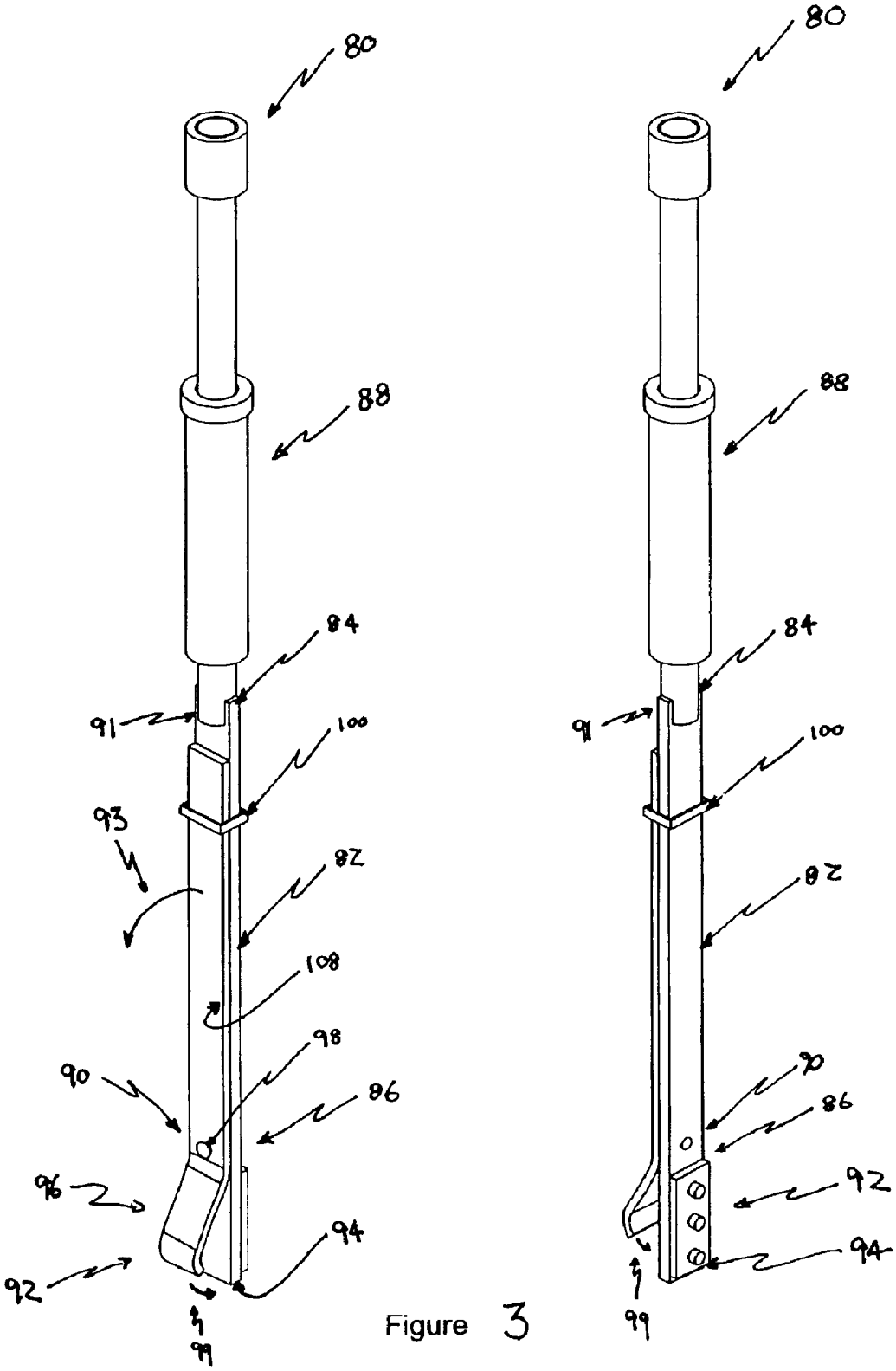
FIG. 3 illustrates two perspective views of the present invention.

Referring to FIG. 3, there is shown two perspective views of a preferred embodiment of the present invention shown generally as (80), namely, a tool adapted to remove the remnant of a square sign post from a sign post anchor. The tool (80) comprises a shaft portion (82) having a top end (84) and bottom end (86). The shaft portion is generally rectangular. A sliding hammer mechanism (88) is connected at connection (91) to the top end (84) of the shaft (82). The connection (91) is generally a welded connection strong enough to withstand the impact forces generated by the hammer mechanism. The connection may also be a suitable riveted or bolted connection. Clamping means, shown generally as (92), are positioned at the bottom end (86) of the shaft (82) for securely engaging the square sign post remnant for extraction as further described herein. The upwards impacting motion of the sliding hammer mechanism imparts extraction forces through the shaft portion to the clamp means for extracting the signpost remnant.

Still referring to FIG. 3, the clamping means (92) comprises a stationary clamp member (94) fixed to the bottom end (86) of the shaft portion (82). The stationary clamp member is integral to the shaft and is an extension thereof. Moveable clamp member, generally shown as (96), is pivotally mounted to the shaft portion (82) at connection point (90) using suitable connection means (98) permitting pivoting motion as illustrated by arrows (99) and (93) about the connection point (90) and as illustrated in subsequent figures. Generally the connection means will comprise a bolt or rivet and will permit swinging movement (99) and (93) of the moveable clamp member (96) towards and away from said stationary clamp member (94). This permits the clamping means to be inserted easily into the sign post remnant without interference from the signpost remnant. As further explained below, the moveable clamp member, once inserted into the remnant, is moved in the opposite direction to the stationary clamp member so that there is cooperation between them to permit firm engagement between the clamping means and the sign post remnant. There is also retaining means (100) for retaining the handle portion (108) of moveable clamping member (96) in a stationary position with respect to the shaft portion (82) when the tool is not in use. This prevents the handle portion (108) from movement that could damage the pivot connection (98) or the handle portion (108) that might occur when the tool is loosely stored in a tool box.

Figure 4:
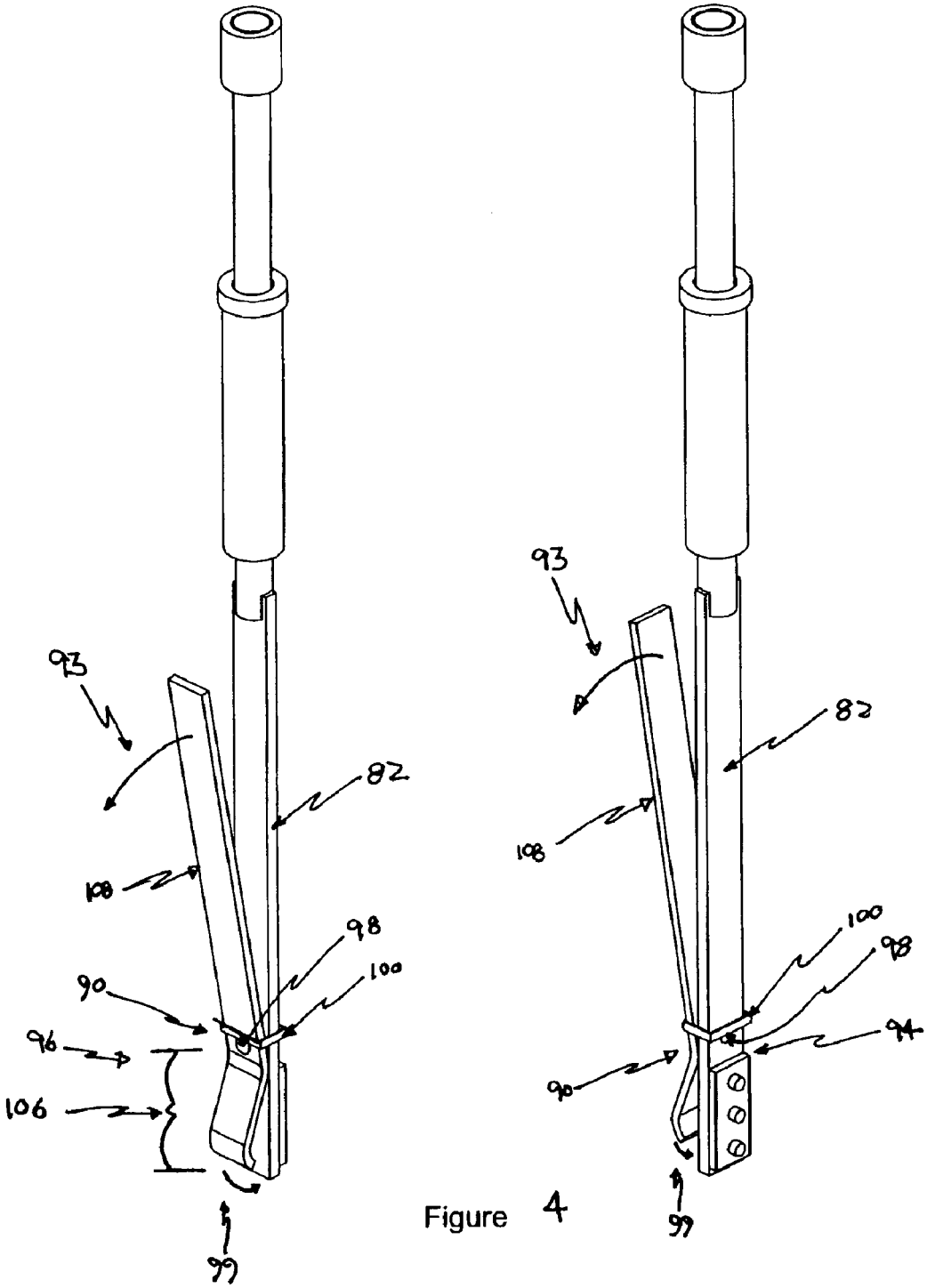
FIG. 4 illustrates the invention with the retaining collar in a loose position just prior to the insertion of the invention into the sign post remnant.

Referring now to FIG. 4, there is shown additional detail of the moveable clamp member (96) comprising a lower biasing portion shown in parenthesis (106) and a flat upper handle portion (108). The moveable clamp member (96) is pivotally connected at a pivot point (90) by the pivot connecting means (98) to the shaft portion (82) substantially at a point where the lower biasing portion (106) and the upper handle portion (108) meet. The lower portion (106) is positioned opposite the stationary clamping member (94) and the upper handle portion (108) is positioned adjacent to the shaft portion (82). In FIG. 4, the retaining collar (100) is shown at the bottom of the shaft and handle in its loosened position permitting pivoting motion (99) and (93) of the moveable clamp member (96).

Figure 5:
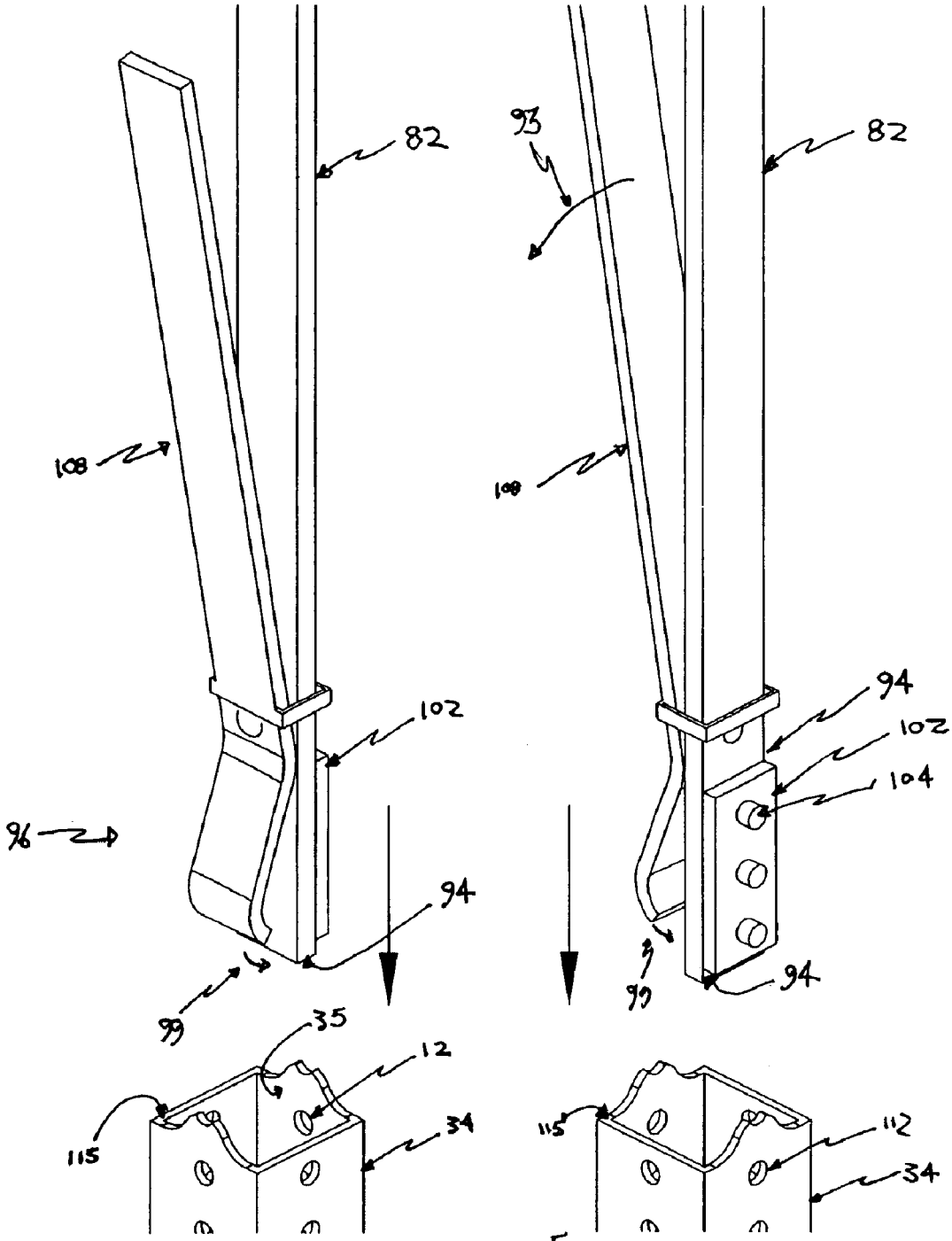
FIG. 5, illustrates the invention being inserted into the remnant.

Referring to FIG. 5. additional detail of the stationary clamp member (94) is illustrated as further comprising a guide member (102) fixed thereto. The guide member has a plurality of pins (104) projecting outwardly from it in order to enter and tightly engage the holes (12) in the remnant (34) from the inside surface (35) of the remnant (34). In the embodiment shown in FIG. 5, there are three pins on the guide member (102) but it is contemplated that there may be fewer or more pins to suit various applications. The pins (104) have a diameter and spaced relationship adapted to the diameter and spaced relationship of the holes (12) in the signpost remnant (34) so that when the clamping means is inserted into the sign post remnant the pins on the guide member will enter and tightly engage the holes in the signpost remnant for extraction.

Figure 6:
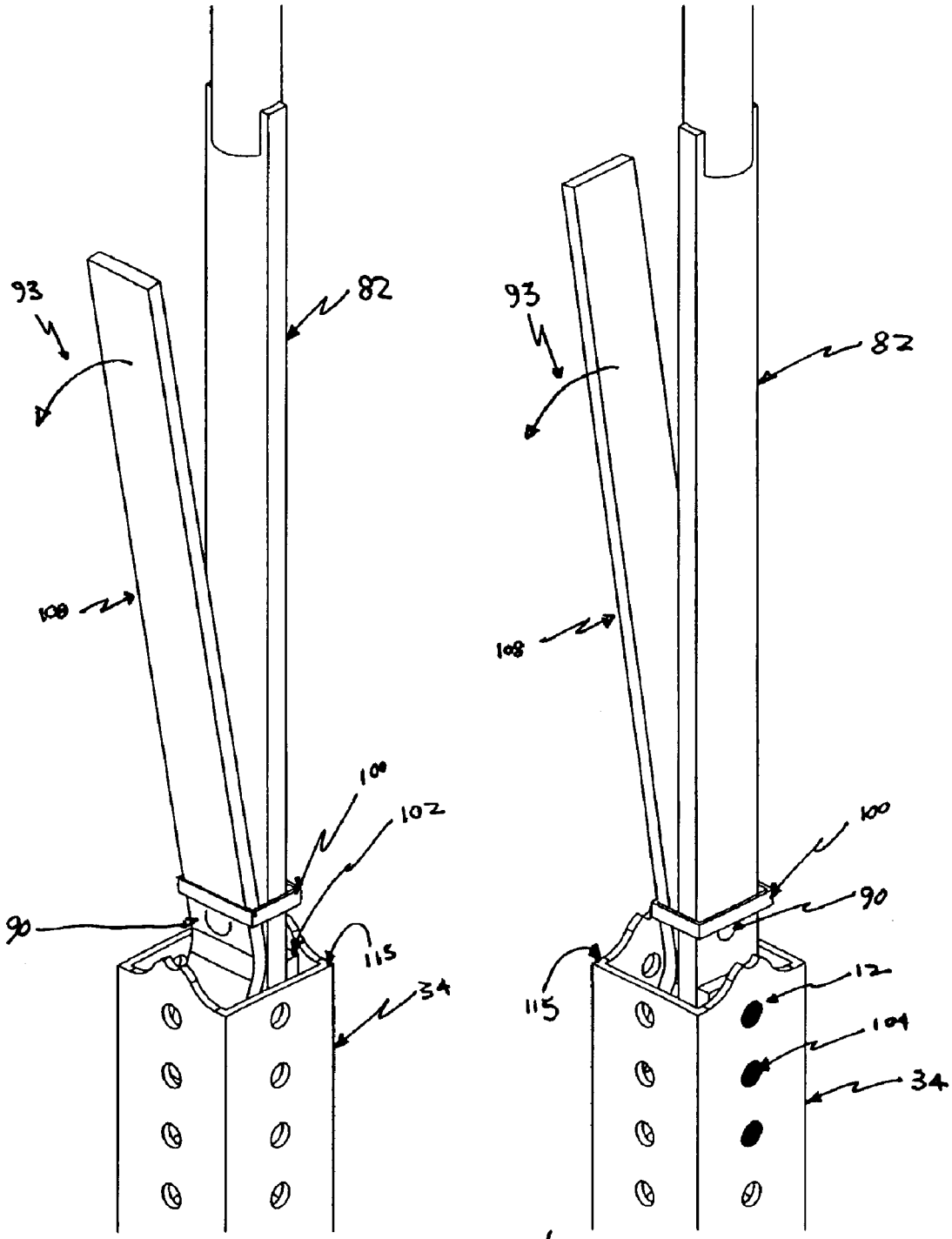
FIG. 6 illustrates the invention inserted into the remnant showing the pins engaged in the remnant holes.

Referring now to FIG. 6, there is illustrated in two perspective views of the clamping means of the invention as it would appear inserted into a square sign post remnant (34). The moveable clamping member (96) has been pivoted about pivot point (90) by moving handle portion (108) away from the shaft (82) as shown by arrow (93). The retaining collar (100) is shown in its loosened position at the bottom of the shaft and handle. The guide member (102) has been inserted into the remnant (34) so that the pins (104) enter and tightly engage the holes (12) in the remnant (34).

Figure 7:
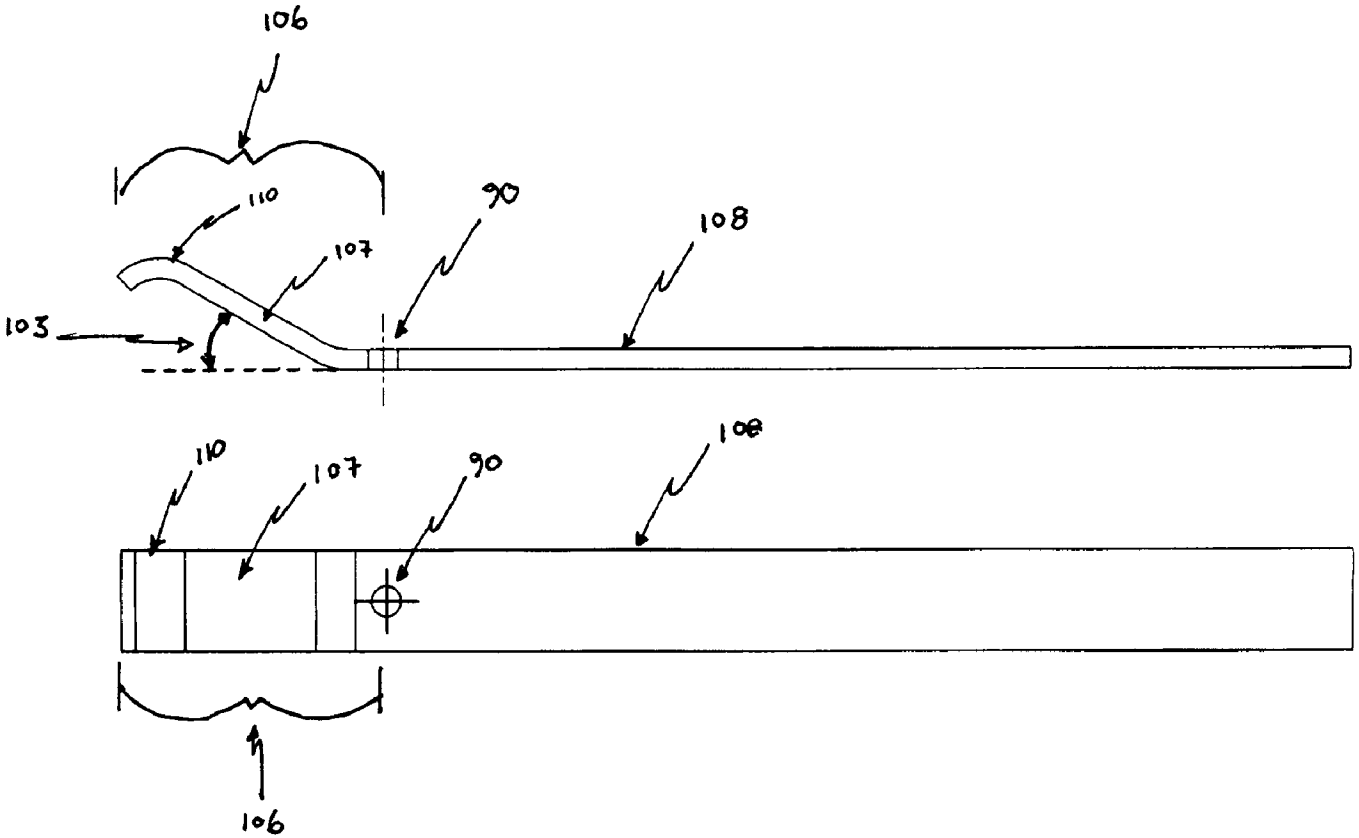
FIG. 7 illustrates in plan and elevation the moveable clamp member and handle portion.

Referring now to FIG. 7, there is illustrated the moveable clamp member (96) in plan and elevation view. Shown are handle (108), pivot point (90), biasing portion (106), spring section (107), bearing section (110) and angle (103). The angle (103) is generally about 30 degrees but may be more or less than 30 degrees as long as it is sufficient to impart a biasing characteristic to spring section (107).

Figure 8:
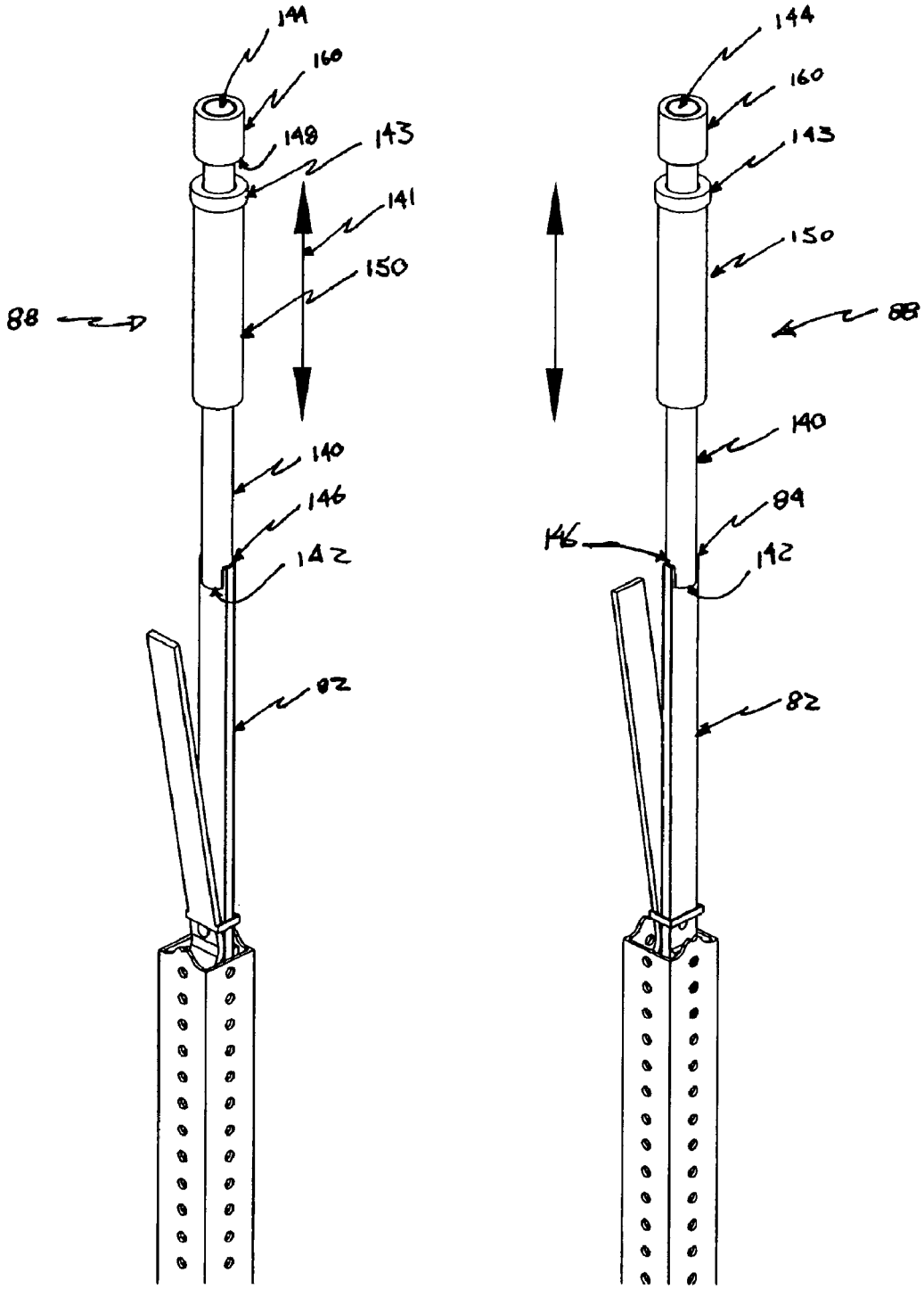
FIG. 8 illustrates in two perspective views, the hammer mechanism of the invention.

Referring to FIG. 8, there is shown in two perspective views the sliding hammer mechanism shown generally as (88) comprising an elongated rod (140) having first (142) and second (144) ends. A first abutment (146) is stationarily mounted on the first end (142). The first end is fixed to the top end (84) of shaft (82). A second abutment (148) is mounted to the second end (144) by way of end cap (160). An impact member (150) is movably disposed on the rod (140) and is freely slidable as illustrated by arrow (141) between the first and second abutments thereby being effective to apply a striking force to the first and second abutments. A collar (143) is also included on the impact member (150) so as to prevent the slippage of the operator's hand from the impact member on the upward stroke of the impact member. It is obvious that in order to remove the remnant from the anchor post by imparting extraction forces thereto, the upwards force on the hammer member that will be much greater than the downwards force.

Figure 9:
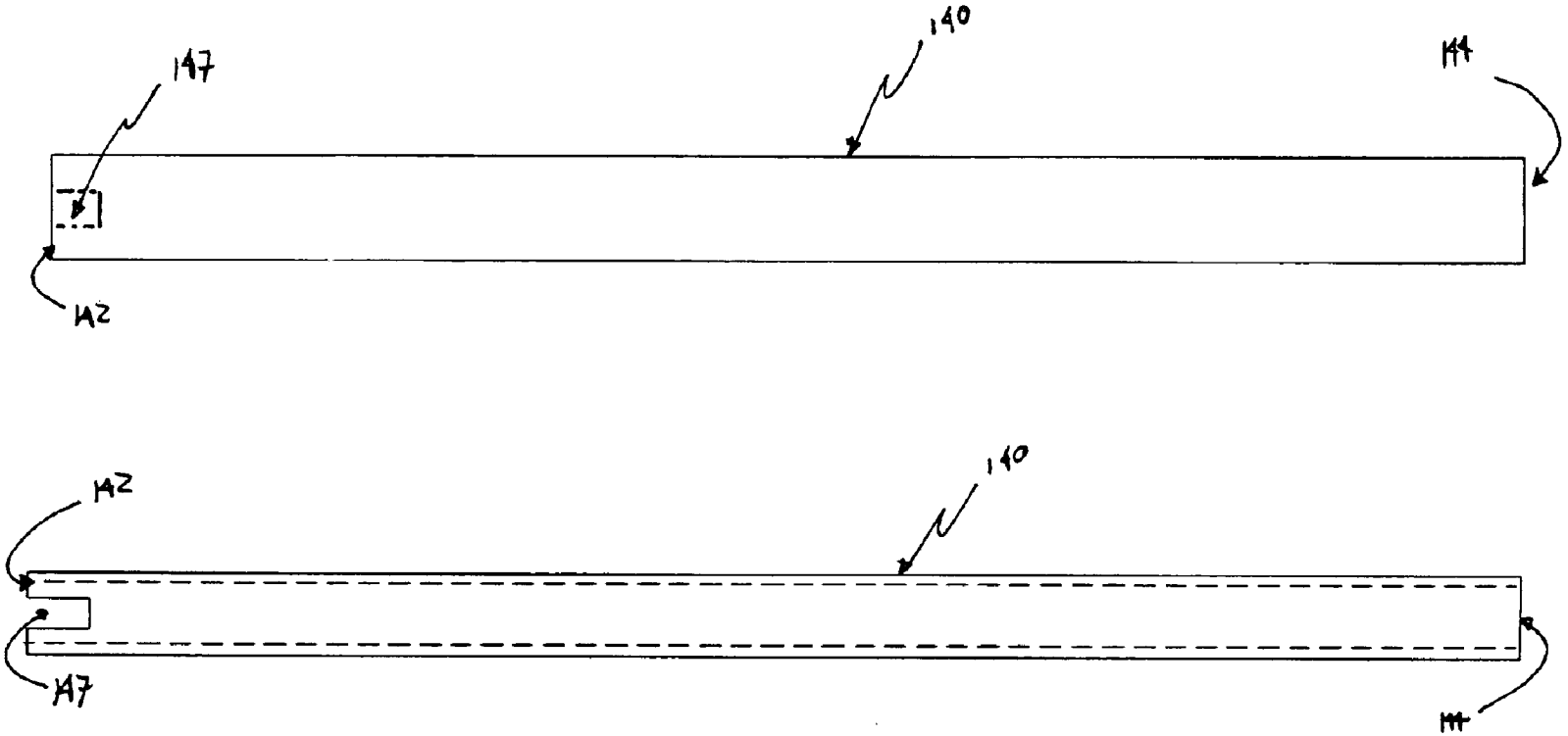
FIG. 9 illustrates the rod portion of the hammer mechanism of the invention.
Figure 10:
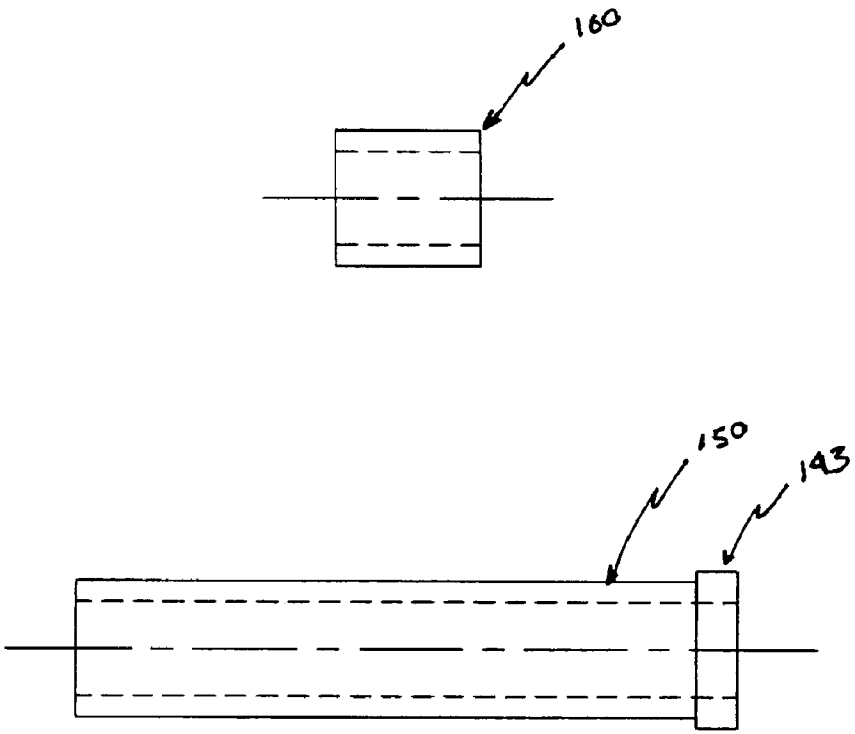
FIG. 10 illustrates the impact member and end cap of the hammer mechanism of the invention.

Referring to FIG. 9, there is illustrated the rod (140) of the hammer mechanism having a first end (142) and a second end (144). First end (142) includes slot (147) adapted to engage the member (82). FIG. 10 illustrates the end cap (160) and the hollow tubular impact member (150) having collar (143) thereon.

Figure 11:
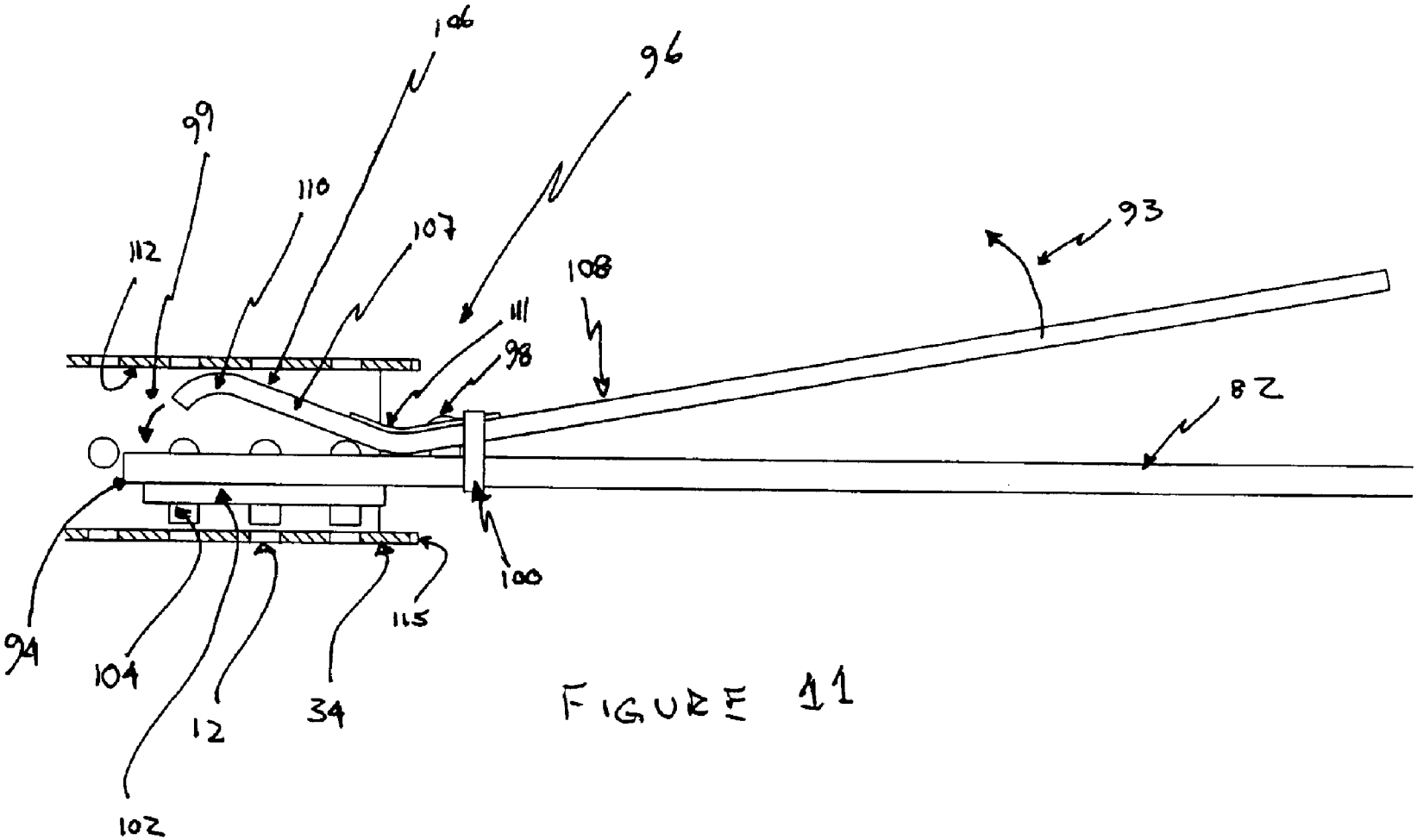
FIG. 11 illustrates in sectional side view, the clamping means being inserted into the remnant.

Referring now to FIG. 11, there is illustrated in cross-sectional side view the moveable clamp member (96) further comprises a rectangular stiffening member (111) positioned over the pivot point (90) and between the lower biasing portion (106) and the upper handle portion (108). The stiffing member is fixed to the top portion of the moveable clamp member at the pivot point using the pivot connection means (98). The stiffening member adds further strength at the pivot point to resist strains caused by movement of the moveable clamping member and further adds additional resilience to the lower biasing portion of the moveable clamping member (96) thereby generating greater biasing forces. The lower biasing portion (106) of the moveable clamping member (96) includes a spring section (107) adjacent to a bearing section (110). The bearing section (110) abuts the inside surface (112) of the signpost remnant (34) when the clamp is in a biased position.

Still referring to FIG. 11, there is illustrated in cross-section side view the clamping means (92) inserted into a remnant (34). The clamping means is in a relaxed position. In this position, the moveable clamping member (96) is pivotable (99) towards the stationary clamping member (94) by moving (93) the handle portion (108) in a direction away from the shaft (82) so that the clamping means may be inserted into the signpost remnant (34) without contacting the outer edges of the remnant (115).

Figure 12:
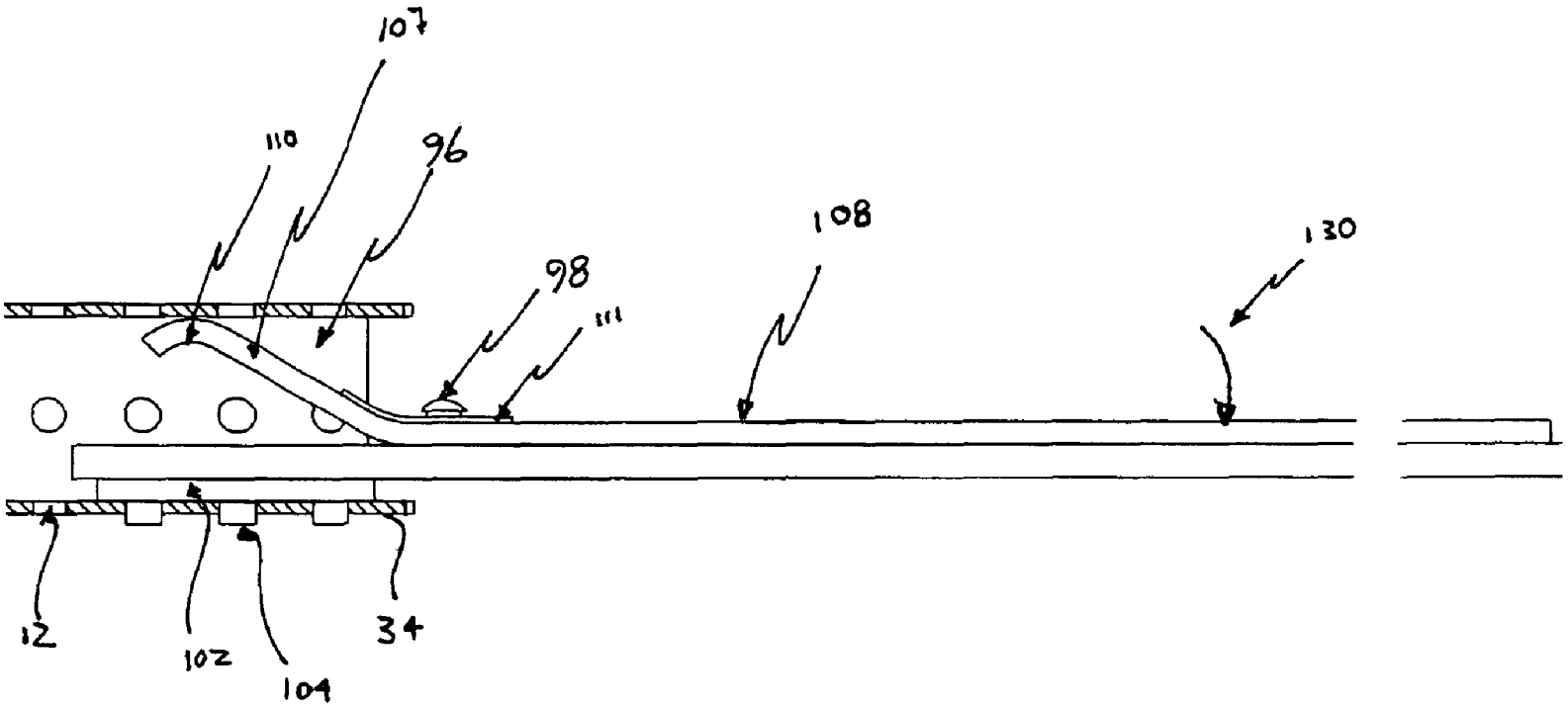
FIG. 12 illustrates in sectional side view, the clamping means engaged with the remnant.

Referring to FIG. 12, there is illustrated in cross-sectional side view second operating position of clamping means (92) is illustrated. The handle (108) is moved (130) towards the shaft (82). This causes the bearing portion (110) of the moveable clamping member (96) to abut the inner surface (112) of the remnant (34) and exert a biasing force against it. The spring section (107) is tensioned as the handle (108) is drawn towards the shaft (82) by hand forces causing the biasing force that forces the guide member (102) and pins (104) of the stationary clamping member (94) into tight engagement with the signpost remnant (34) holes (12) for extraction.

The tool is fabricated from steel having a suitable hardness.

The easy and simple operation is now explained. Referring to FIG. 4, there is seen the invention with the retaining collar (100) loosened and the handle (1 08) available for movement (93). Referring to FIG. 5, the handle (108) is moved (93) away from shaft (82) by hand forces so that the moveable clamping member (96) is moved (99) towards the stationary clamping member (94). As shown in FIG. 6, this permits entry of the clamping means into the remnant (34) without interference from the edge (115) of the remnant. Referring still to FIG. 6, the invention is shown engaged with the remnant. FIG. 12 shows that biasing movement (130) is applied to the handle (108) to firmly engage the clamping means with the remnant. Referring to FIG. 8, once the clamping means is firmly engaged with the remnant, the operator applies impact forces using the hammer (150) against the upper abutment (148) thereby forcing the remnant from the anchor. Experimental field use of the invention has shown that only three or four strokes of the impact member are required to remove a remnant.

Accordingly the reader will see that my invention provides a simple and hand operated tool and method of extracting remnants of square sheared signposts from anchors. The tool is quick and convenient to operate with out further damage to the anchor permitting recycling of the signpost foundation and anchor.

Thus, having described the preferred embodiment of the invention and the best mode presently known for implementing the invention it is to be understood that certain changes could be made to the device disclosed herein without departing from what is considered to be the scope of this invention. Therefore, this specification is not to be taken in the limiting sense, but instead is to be taken and read for the purpose of interpreting the claimed invention as set forth in the following claims. Such claims and only such claims when interpreted in accordance with well established doctrine define the legal monopoly claimed herein.

What is claimed is:

1. A tool for extracting the sheared remnants of sign posts said sign posts having holes therein said tool comprising:

a. a shaft portion having a top and bottom end;

b. a clamp positioned at said bottom end of said shaft portion for securely engaging said sign post remnant wherein said clamp comprises:

i. a stationary clamp member integral to the bottom end of the shaft portion;

ii. a moveable clamp member pivotally connected by pivot means to said stationary clamp member so that said moveable clamp member is permitted pivoting movement towards and away from the stationary clamp member;

iii. a guide member fixed to the stationary clamp member, said guide member comprising a plurality of pins projecting outwardly there from and having a diameter and spaced relationship corresponding to the diameter and spaced relationship of the holes in the sign post remnant, so that when the clamp is inserted into the sign post remnant the pins on the guide member enter and tightly engage the holes in the signpost remnant; and, c. a sliding hammer mechanism connected to said top end of the shaft portion for imparting extraction forces to the signpost remnant engaged by the clamp.

2. The tool of claim 1 wherein the moveable clamp member comprises a lower biasing portion and an upper handle portion, wherein the moveable clamp member is pivotally connected at a pivot point to the stationary clamp member at a point substantially where said lower biasing portion and said upper handle portion join, further wherein the lower biasing portion is positioned opposite the stationary clamping member and the upper handle portion is positioned adjacent to the shaft portion.

3. The tool of claim 2 wherein the moveable clamp member further comprises a stiffening member fixed to thereto and positioned between the lower biasing portion of the upper handle portion of the moveable handle portion, wherein said stiffing member is fixed by fixing means to the moveable clamp member at the pivot point, whereby the stiffening member adds further resilience to the biasing portion thereby generating greater biasing forces therein.

4. The tool of claim 3 wherein the lower biasing portion of the moveable clamping member comprises a spring portion fixed to a bearing portion said bearing portion adapted to abut the inside surface of the sign post remnant.

5. The tool of claim 4 wherein the clamping means has a first relaxed position and a second biased position, where in said first relaxed position the moveable clamping member is pivoted towards the stationary clamping member by moving the handle portion in a direction away from the shaft so that the clamping means may be inserted into the signpost remnant, and where in the said second biased position the handle portion is moved by hand force towards the shaft causing the bearing portion of the lower biasing portion to abut the inner surface of the signpost remnant and apply a biasing force to the spring portion thereby forcing the guide member and pins of the stationary clamping member into tight engagement with the signpost remnant holes for extraction.

6. The tool of claim 5, further comprising retaining means for retaining the moveable clamp member handle stationary with respect to and adjacent to the shaft portion, said retaining means comprising a collar member moveably disposed on the shaft and handle and freely slidable on the shaft and handle between a first loose position and a second fixed position.

7. The tool of claim 6, wherein said first loose position occurs when said collar is disposed at the pivot point and wherein said second fixed position occurs when the collar is positioned up the handle portion and shaft portion by hand forces until the collar is in frictional engagement with the handle portion and shaft portion.

8. The tool of claim 7 wherein the sliding hammer mechanism comprises:

a. an elongated rod having first and second ends;

b. a first abutment stationarily mounted on said first end wherein the first end is fixed to the said top end of the shaft portion;

c. a second abutment stationarily mounted on said second end; and, d. an impact member movably disposed on the first elongated shaft and freely slidable between the first and second abutments and being effective to apply an upwards striking force to the second abutments on the upwards stroke thereof.

9. The tool of claim 8, wherein said impact member further includes a collar adapted to prevent the operator's hand from slipping from the impact member on said upwards stroke.

10. The tool of claim 9 wherein the tool is fabricated from steel having hardness sufficient to resist the forces generated by extraction of sheared remnants.

11. A tool for extracting the sheared remnants of sign posts said sign posts having holes therein said tool comprising:

a. a rectangular shaft portion having a top and bottom end;

b. a sliding hammer mechanism connected to the top end of said shaft portion;

c. clamping means positioned at the bottom end of the shaft portion for securely engaging said sign post remnant wherein said clamping means comprises:

i. a stationary clamp member integral to the bottom end of the shaft portion;

ii. a moveable clamp member pivotally connected to said stationary clamp member for pivoting movement towards and away from the stationary clamp member so that when the clamping means is inserted into the sign post remnant the stationary and moveable clamp members cooperate to permit the firm engagement the remnant for extraction; and, iii. means for pivotally connecting the moveable clamp member to the stationary clamp member.

12. A method of extracting the remnants of sign posts, having holes therein, said method comprising the following steps:

a. providing a tool having:

i. a shaft portion having a top and bottom end;

ii. a sliding hammer mechanism connected to the top end of said shaft portion; and, iii. clamping means positioned at the bottom end of the shaft portion for securely engaging sign post remnant;

b. securely engaging clamping means to the sign post remnant; and, c. causing the sliding hammer mechanism imparts extraction forces through the shaft portion to the clamp means for extracting the signpost remnant.

13. A method according to claim 12, wherein the wherein the clamping means comprises:

a. a stationary clamp member fixed to the bottom end of the shaft portion;

b. a moveable clamp member pivotally connected to said stationary clamp member for pivoting movement towards and away from said stationary clamp member so that when the clamping means is inserted into the sign post remnant the stationary and moveable clamp members cooperate to permit the firm engagement the remnant; and, c. means for pivotally connecting the moveable clamp member to the stationary clamp member.

14. A method according to claim 13 wherein the stationary clamp member further comprises a guide member mounted thereon, said guide member having a plurality of pins projecting outwardly there from; said pins having a diameter and spaced relationship adapted to correspond to the diameter and spaced relationship of the holes in the signpost remnant, so that when the clamping means is inserted into the sign post remnant the pins on the guide member will enter and tightly engage the holes in the signpost remnant for extraction.

15. The method according to claim 14 wherein said moveable clamp member comprises a lower biasing portion and an upper handle portion, the moveable clamp member pivotally connected to the stationary clamp member at a point substantially where the lower biasing portion and the upper handle portion join, further wherein the lower biasing portion is positioned opposite the stationary clamping member and the upper handle portion is positioned adjacent to the shaft portion.

16. A method extracting of remnants of sign posts, said method comprising the following steps:

a. providing a tool having:

i. a shaft portion having a top and bottom end;

ii. a sliding hammer mechanism connected to the top end of said shaft portion; and, iii. clamping means positioned at the bottom end of the shaft portion for securely engaging the sign post remnant;

b. placing clamping means in a first relaxed position by pivoting the moveable clamping member toward the stationary clamping member by moving the handle portion in a direction away from the shaft;

c. inserting the relaxed clamping means into the signpost remnant so that all of the pins on the guide member will engage the holes in the signpost remnant;

d. biasing the moveable clamping member against the inside of the sign post remnant by moving the handle portion towards the shaft thereby causing the bearing portion to sit against inside surface of the signpost remnant and flexing the spring portion thereby forcing the guide member of the stationary clamping member into tight engagement with the signpost remnant for extraction; and, e. causing the sliding hammer mechanism imparts extraction forces through the shaft portion to the clamp means for extracting the signpost remnant.

* * * * *